US005495831A

United States Patent [19]

Paul et al.

[11] Patent Number: 5,495,831

[45] Date of Patent: Mar. 5, 1996

[54] VALVE ACTUATING MECHANISM FOR AN INTERNAL COMBUSTION ENGINE

[75] Inventors: Michael Paul, Bad Friedrichshall; Peter Hubschle; Wilhelm Hannibal, both of Neckarsulm, all of Germany

[73] Assignee: Audi AG, Germany

[21] Appl. No.: 290,893

[22] PCT Filed: Feb. 5, 1993

[86] PCT No.: PCT/EP93/00276

§ 371 Date: Sep. 30, 1994

§ 102(e) Date: Sep. 30, 1994

[87] PCT Pub. No.: WO93/17227

PCT Pub. Date: Sep. 2, 1993

[30] Foreign Application Priority Data

Feb. 21, 1992 [DE] Germany ..... 42 05 230.0

[51] Int. Cl.[6] ..... F01L 13/00; F01L 1/26

[52] U.S. Cl. ..... 123/90.16; 123/90.22

[58] Field of Search ..... 123/90.15, 90.16, 123/90.17, 90.22, 90.27, 90.39, 90.44, 90.4, 308, 432

[56] References Cited

U.S. PATENT DOCUMENTS

| | | | |
|---|---|---|---|
| 4,762,096 | 8/1988 | Kamm et al. | 123/90.16 |
| 4,799,463 | 1/1989 | Konno | 123/90.16 |
| 4,809,663 | 3/1989 | De Tomaso | 123/432 |
| 4,844,023 | 7/1989 | Konno et al. | 123/90.16 |
| 5,101,778 | 4/1992 | Fukuo et al. | 123/90.16 |

FOREIGN PATENT DOCUMENTS

| | | |
|---|---|---|
| 0235981 | 9/1987 | European Pat. Off. . |
| 0342007 | 11/1989 | European Pat. Off. . |
| 3800347 | 9/1988 | Germany . |
| 216014 | 10/1985 | Japan . |
| 1158772 | 5/1985 | U.S.S.R. . |

*Primary Examiner*—Weilun Lo
*Attorney, Agent, or Firm*—Lalos & Keegan

[57] ABSTRACT

An actuating mechanism for three inlet valves of a cylinder of an internal combustion engine has three first rocker arms, each of which actuates an inlet valve and is actuated by a first cam for a lower revolution speed range, and two second rocker arms which are arranged between adjacent first rocker arms and are actuated by second cams for the upper speed range. The first and second rocker arms are coupled in the upper speed range so that the valves are actuated in accordance with the contour of the second cams.

10 Claims, 5 Drawing Sheets

VALVE ACTUATING MECHANISM FOR AN INTERNAL COMBUSTION ENGINE

BACKGROUND OF THE INVENTION

The invention relates to a valve actuation mechanism for an internal combustion engine with three inlet valves per cylinder which are actuated by cams of a camshaft by way of rocker arms.

In a known valve actuation mechanism of this type (e.g. DE-A 38 00 347), two first rocker arms are provided for actuating two inlet valves, which rocker arms interact with identical first cams so that in the first (lower) rotational speed range, all the inlet valves are actuated in an identical manner. Two second rocker arms are arranged between the first rocker arms or outside the same and these second rocker arms interact with different second cams. In one embodiment, each second rocker arm can be coupled to the adjacent first rocker arm. In another embodiment, the first rocker arms are connected together by a bridge and one or the other second rocker arm can be optionally coupled to the bridge and, by this means, to the two first rocker arms. For the actuation of three inlet valves, two first rocker arms interacting with identical cams are provided in a manner analogous to the second embodiment. These rocker arms are connected together by a bridge which acts on the three inlet valves. The two second rocker arms, which are arranged adjacent to one another and between the two first rocker arms, can be optionally coupled to the bridge and, by this means, to the two first rocker arms. In these known embodiments, the opening force exerted by the second cams in the coupled condition acts to one side of the first rocker arms or asymmetrically on the bridge connecting the first rocker arms together so that a tipping moment is generated which makes the decoupling, in particular, more difficult and, in the extreme case, can lead to jamming of the coupling means.

JP-A-60-216014 describes a valve actuation mechanism for an internal combustion engine with three inlet valves per cylinder which are actuated via rocker arms by cams of a camshaft. In this publication, each valve has its own rocker arm associated with it, which rocker arm is supported on its own rocker arm support and interacts with its own cam. No second rocker arms are provided to connect for valve control as a function of rotational speed, to the three rocker levers by coupling means.

SUMMARY OF THE INVENTION

The object of the invention is to create a valve actuation mechanism of the generic type, for an internal combustion engine with three inlet valves per cylinder, in which different control times can be effected for the three inlet valves in the first (lower) rotational speed range and the occurrence of tipping moments is avoided when the first and second rocker arms are coupled.

By using an appropriate configuration of the first cams, for example, it is possible to achieve a reduction in the idling rotational speed in the lowest rotational speed range, without impairing smooth running, by not opening the first inlet valve, by briefly opening the second inlet valve and by opening the third inlet valve for a longer time and with a late beginning of inlet. This is possible because the residual gas proportion, i.e. the quantity of burnt gases in the combustion space, is small due to the lack of overlap between the inlet and exhaust and because the small amount of idling mixture only enters the combustion space via the second and the third inlet valves, with different control periods, and a swirl is generated in the combustion space which contributes to optimum combustion. In the medium rotational speed range, all three inlet valves are in action so that by advancing the "inlet open" control time, a gain in torque is achieved and, because of the overlap between "inlet open" and "exhaust closed" now present, there is an internal exhaust gas recirculation which contributes to a reduction in the formation of oxides of nitrogen. In the upper rotational speed range, the first rocker arms are coupled to the second arms so that the valves can now be operated in accordance with the cam contour of the second cams—with a large lift, long opening duration, early beginning of inlet and late closing of outlet—so that a high power is achieved.

Because the two second rocker arms are respectively located between two adjacent first rocker arms and are coupled to all the first rocker arms in the second (upper) rotational speed range, a one-sided load on the first rocker arms due to the opening force exerted by the second cams, and therefore tipping of the first rocker arms, can be avoided in the coupled condition.

The longitudinal center axes of each first rocker arm and the valve actuated by the latter are preferably located in a common plane. This prevents a tipping moment being exerted on the rocker arms in any operating condition so that tipping of the rocker arms is avoided and the wear between the rocker arms and the cams is reduced.

The two second rocker arms can be rigidly connected together or even be integral because they are actuated by identical cams. They are preferably pivotably supported on the common pin of the first rocker arms.

Whereas in the prior art, the cams act at a location of the rocker arms which is situated between the pivot pin and the contact location of the rocker arms on the valve shaft, a preferred embodiment of the invention provides that the valve center axes of the inlet valves intersect the central axis of the camshaft or cross it at a small distance. This arrangement has the advantage that, because the position of the camshaft is the same in both cases, one and the same cylinder head can be optionally embodied with direct actuation of the inlet valves by the cams of the camshaft by means of cup tappets if variable valve control is not desired or can be provided with actuation of the inlet valves via rocker arms according to the present invention.

In contrast to the embodiment in accordance with DE-A 38 00 347, the present invention provides for coupling the first rocker arms to the second rocker arms so that no sliding of the coupling parts on one another occurs in the decoupled condition.

The present invention also provides for simple coupling due to the fact that the selector roller extends through all the rocker arms.

DETAILED DESCRIPTION

Figure 1:
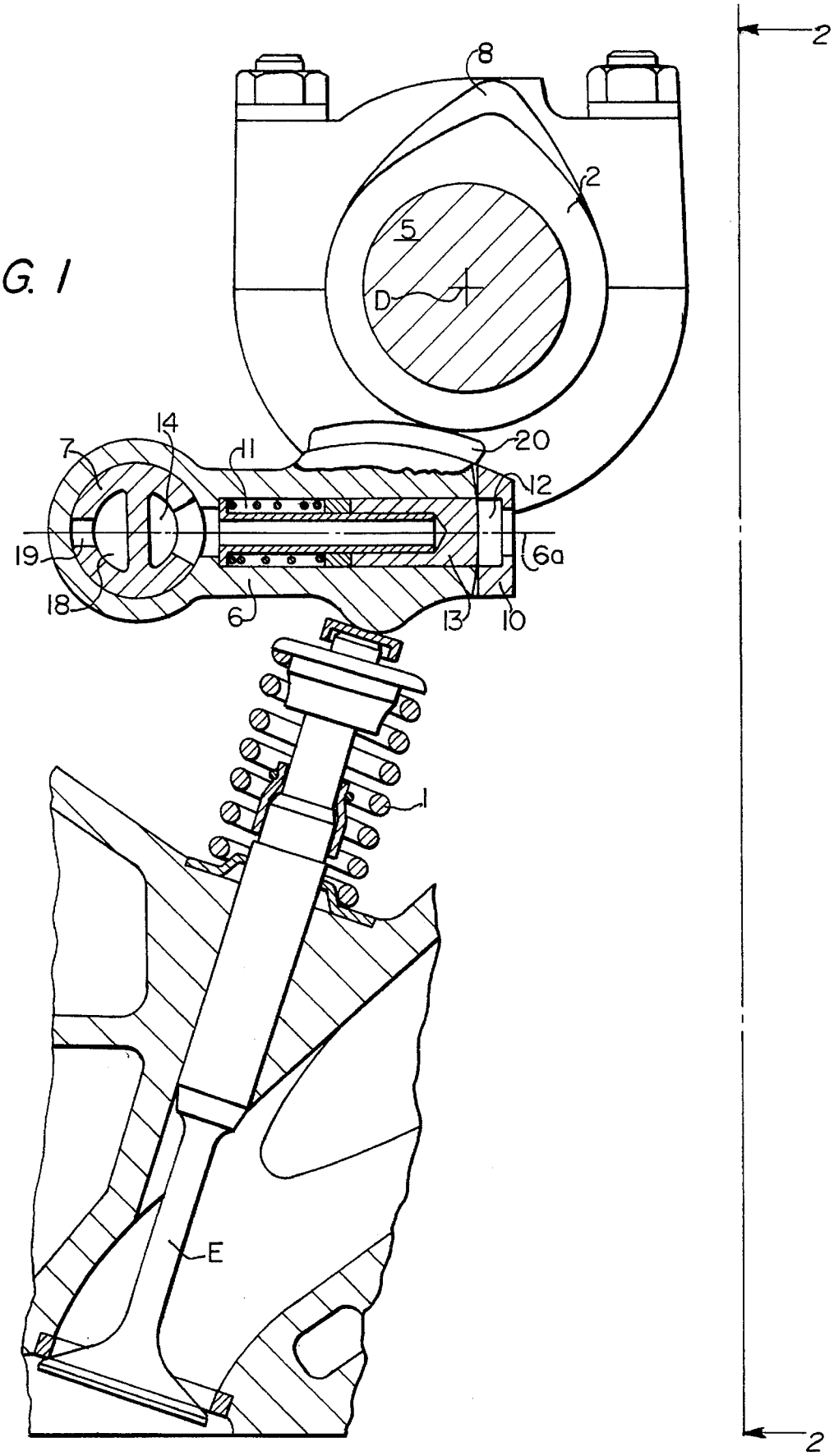
FIG. 1 shows, in a right-angled section along the line 1—1 in FIG. 2, a valve drive with a valve actuation mechanism, according to the invention, for three inlet valves.
Figure 2:
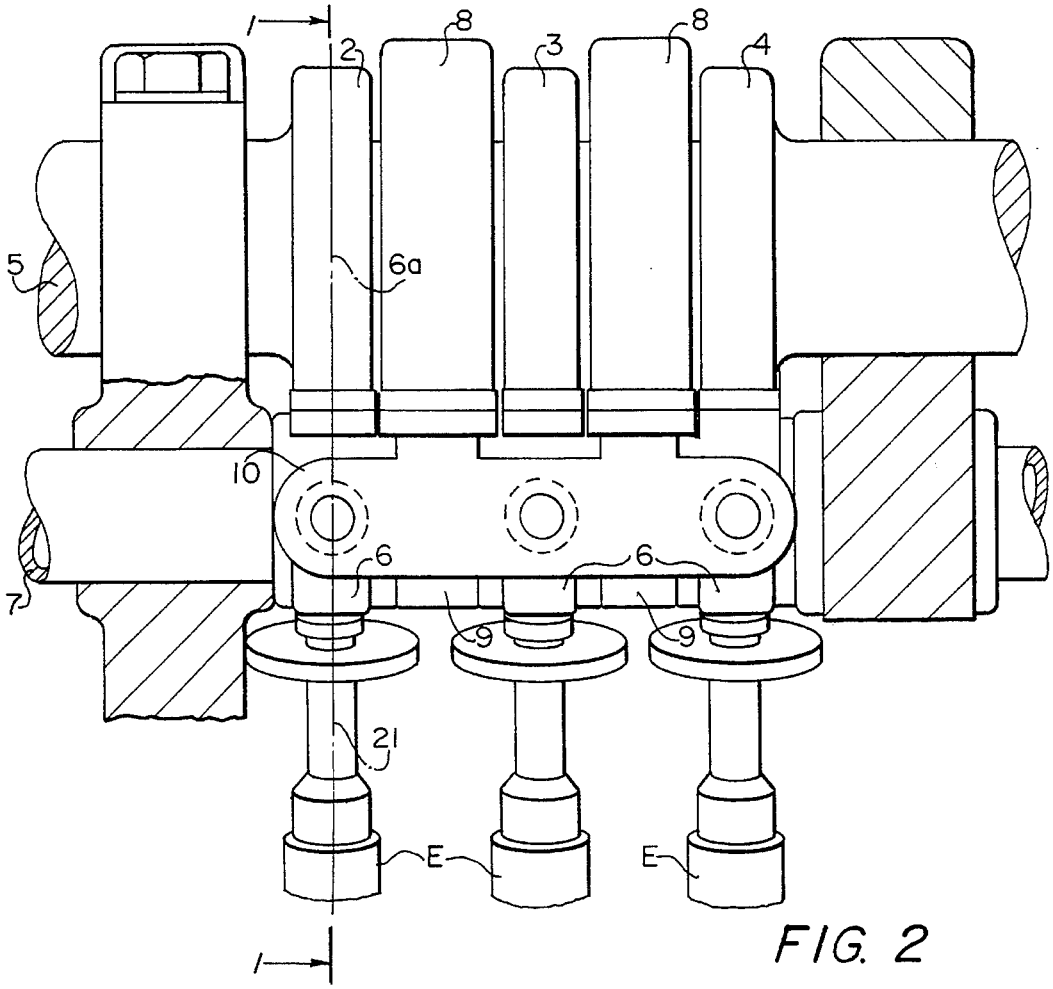
FIG. 2 shows a view in the direction of the arrow 2 in FIG. 1.
Figure 3:
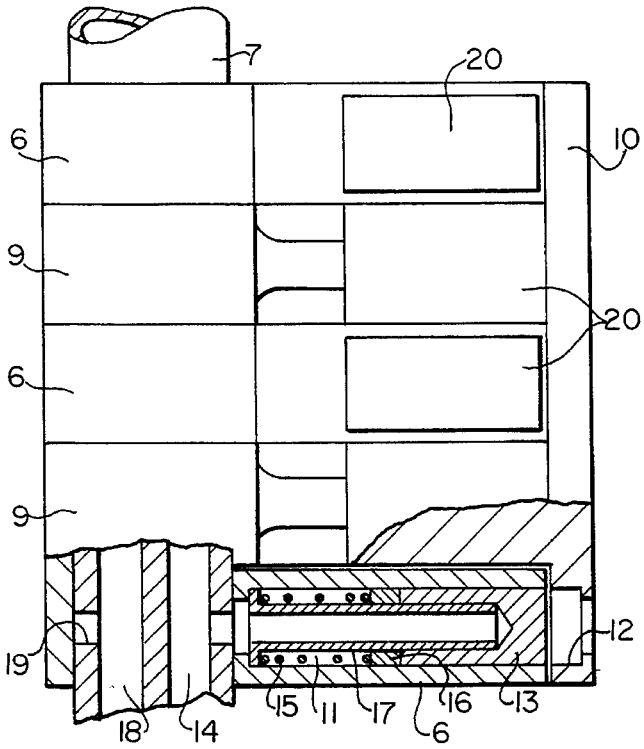
FIG. 3 shows a plan view, partially sectioned, of the valve actuation mechanism of FIGS. 1 and 2.
Figure 4:
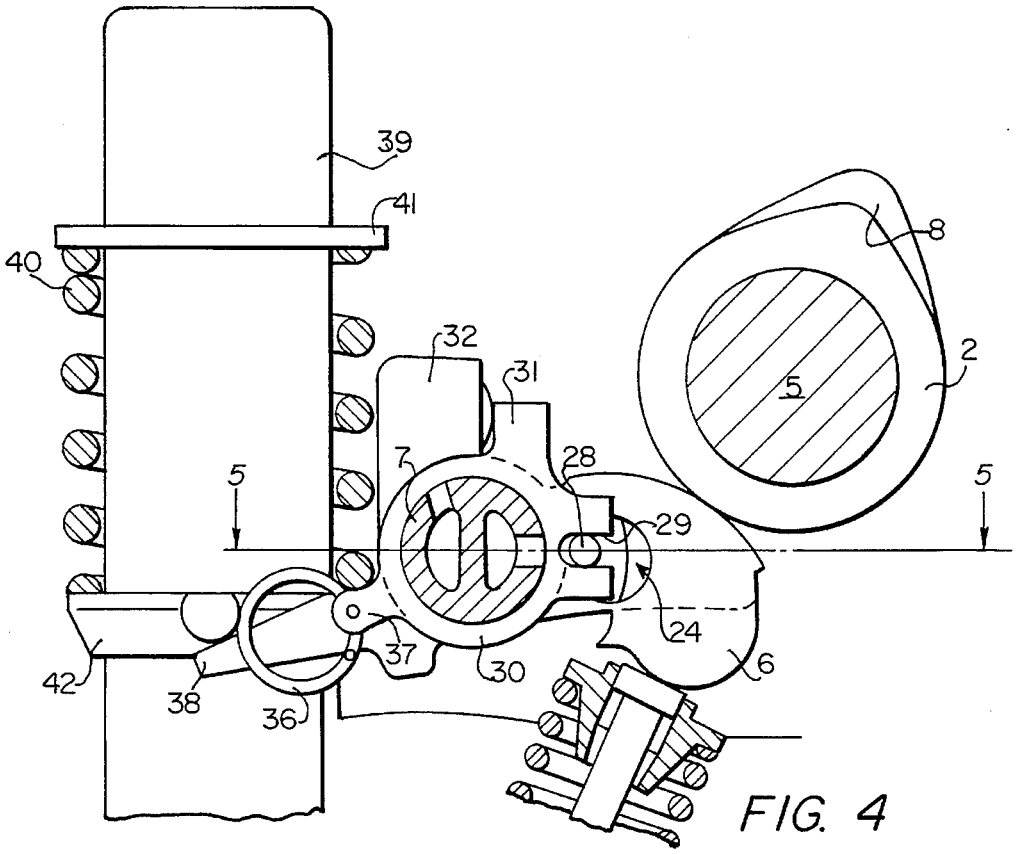
FIG. 4 shows a section, along the line 4—4 in FIG. 5, of a valve drive with a valve actuation mechanism corresponding to a second embodiment example.
Figure 5:
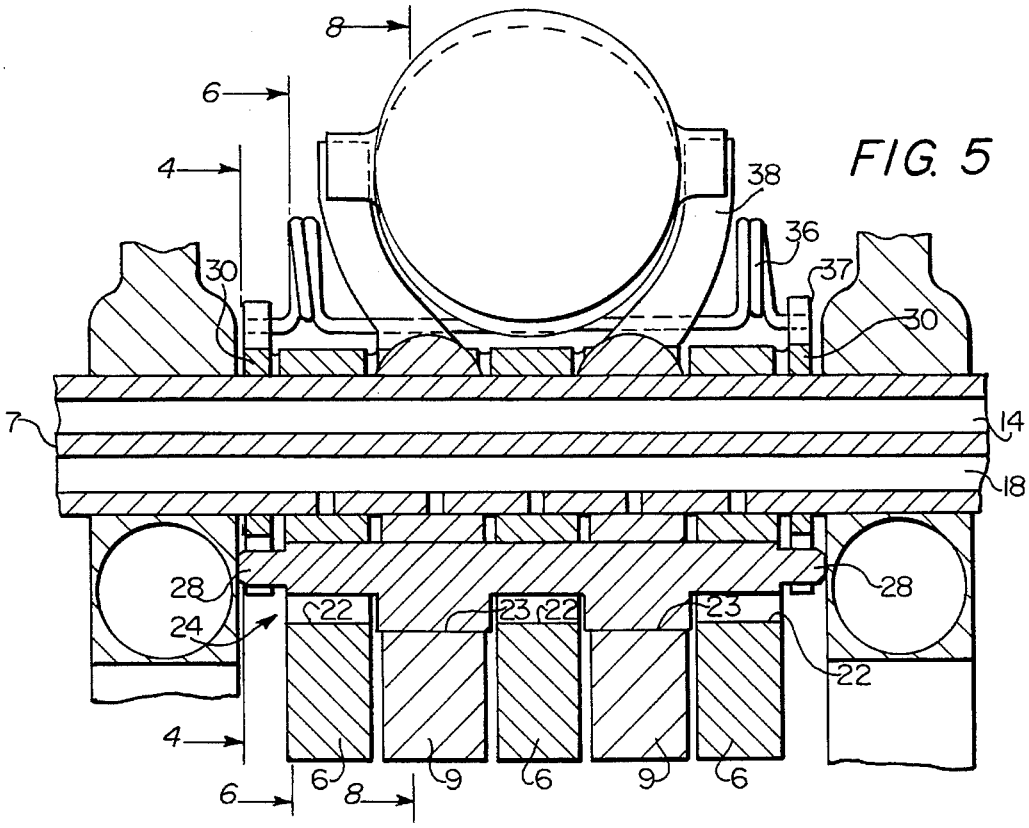
FIG. 5 shows a section along the line 5—5 in FIG. 4.
Figure 6:
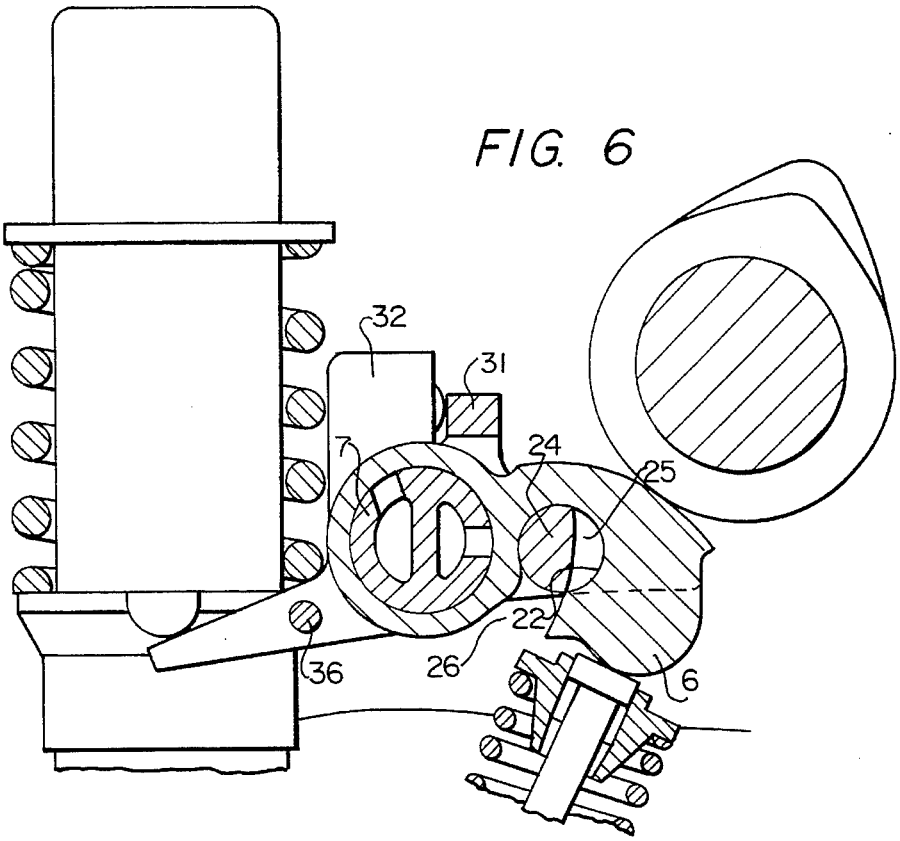
FIG. 6 shows a section along the line 6—6 in FIG. 5 with the selector roller represented in a first position.

A valve drive for three inlet valves E is represented in FIGS. 1 to 3. Each valve E is acted on in the closing direction by a spring 1. The valves are actuated via rocker arms 6 by their own cams 2, 3 and 4 of a camshaft 5, the rocker arms 6 being pivotably supported on a common stationary shaft 7. The cams 2, 3 and 4 preferably have different cam profiles in order to achieve a different valve lift, a different opening duration and/or different control times for the individual inlet valves and in order to create optimum conditions in the lower and medium rotational speed range of the internal combustion engine. Second cams 8 with an identical cam profile are provided on the camshaft 5 between adjacent cams 2, 3 and 4. This cam profile is designed for the relationships in the upper rotational speed range of the internal combustion engine. i.e., it generates a larger valve lift and a longer opening duration, for example. Rocker arms 9 interact with the second cams 8 and can be coupled to the first rocker arms 6 in the upper rotational speed range so that in this rotational speed range, the valves E are actuated in accordance with the contour of the cams 8.

In the embodiment in accordance with FIGS. 1 to 3, the free ends of the second rocker arms 9 are connected together by a tie-bar 10 which extends in front of and at a small distance from the free ends of the first rocker arms 6. Holes 11 are provided in the first rocker arms 6. These holes are radial with respect to the pivot shaft 7 and are aligned with corresponding holes 12 in the tie-bar 10 when the valves E are closed, i.e., when all the rocker arms 6 and 9 are in contact with the base circles of their cams 2, 3, 4 and 8. A piston 13 is arranged in each hole 11 and this piston 13 is pushed outwards by a pressure medium which is supplied through a passage 14 in the shaft 7. The piston 13 then engages in the hole 12 in the tie-bar 10 so that the rocker arms 6 and 9 are coupled together. Each piston 13 is acted upon by a spring 15 which is supported, at one end, on an insert 16 fixed in the hole 11 and, at the other end, on the end of a sleeve 17 which is fastened on the piston 13 and extends through the insert 16. The spring 15 returns the piston 13 into its decoupled position with the insert 16 acting as a stop.

A second oil passage 18, which is connected to the bearing positions of the rocker arms 6, 9 by holes 19, is provided in the shaft 7.

Each rocker arm 6, 9 has a sliding surface 20 by means of which it is in contact on its cam 2, 3, 4 or 8. The second rocker levers 9 are held in contact on their cams 8 by spring elements, which are not shown.

As may be seem from FIG. 1, the arrangement is such that the valve center axes 21 of the inlet valves E intersect the central axis D of the camshaft or cross it at a small distance, as has been proposed in EP 262 250 for a valve control with direct valve actuation, i.e., without rocker arms or tipping arms. If this arrangement is applied to a valve drive in which the valves are actuated by means of rocker arms, it is then possible, without changing the position of the camshaft, to equip an internal combustion engine with a variable valve control corresponding to the present invention or with direct actuation of the valves by means of cup tappets. Furthermore, FIG. 2 shows that the longitudinal center axis *6a* of each rocker arm 6 and the longitudinal center line 21 of the valve E actuated by this rocker arm 6 are located in a common plane, which avoids the rocker arm being acted on by tipping moments.

Reference is now made to the embodiment in accordance with FIGS. 4 to 8, in which the arrangement of the first and second rocker arms is substantially identical to the embodiment in accordance with FIGS. 1 to 3. The type of coupling between the first and second rocker arms 6 and 9 is, however, different. In this embodiment, the first and second rocker arms 6 and 9 have holes 22 and 23, respectively, which extend parallel to their pivot shaft 7 and are coaxial when the valves are closed. A rotatable selector roller 24, which is rotatably supported in the holes 23 of the second rocker arms 9, extends through all the holes and has cut-outs 25 in the region of the holes 22 in the first rocker arms 6. As may be seem from FIGS. 6 and 7, the holes 22 in the rocker arms 6 are open towards the bottom over a partial region 26. When the selector roller 24 is in the position represented in FIG. 6, the second rocker arms 9 can pivot downwards without taking the first rocker arms 6 with them because the selector roller 24 can slide out of these holes because of the cut-outs 25 and the open regions 26 of the holes 22. The valves are therefore actuated in accordance with the contours of the cams 2, 3 and 4.

Figure 7:
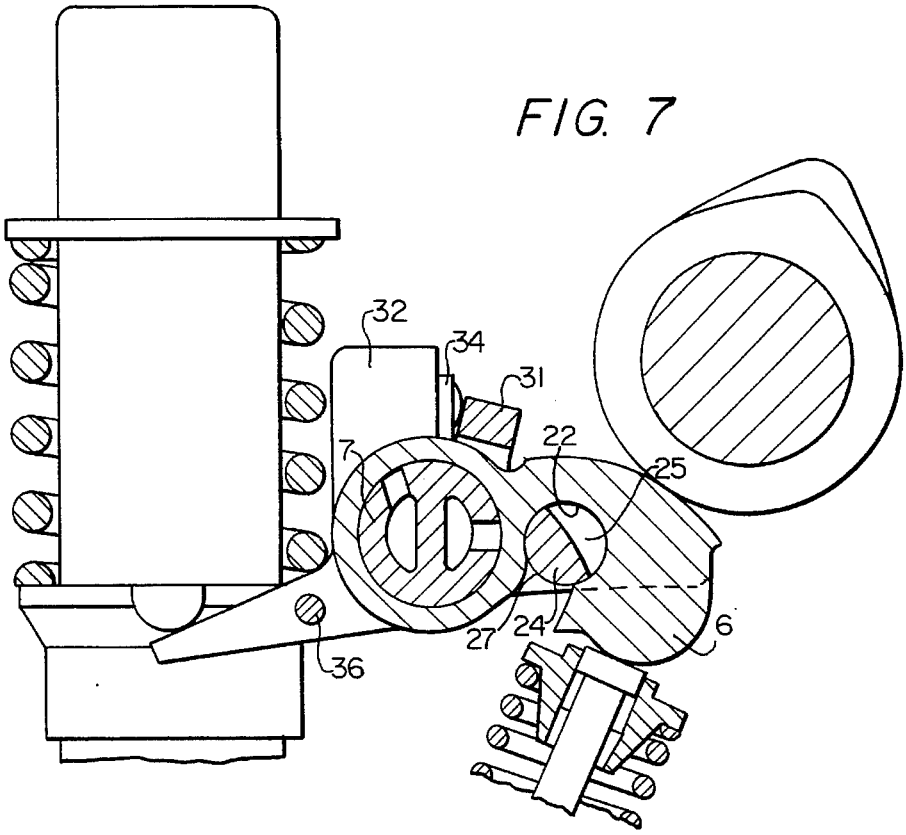
FIG. 7 shows a section corresponding to FIG. 6 with the selector roller represented in a second position.
Figure 8:
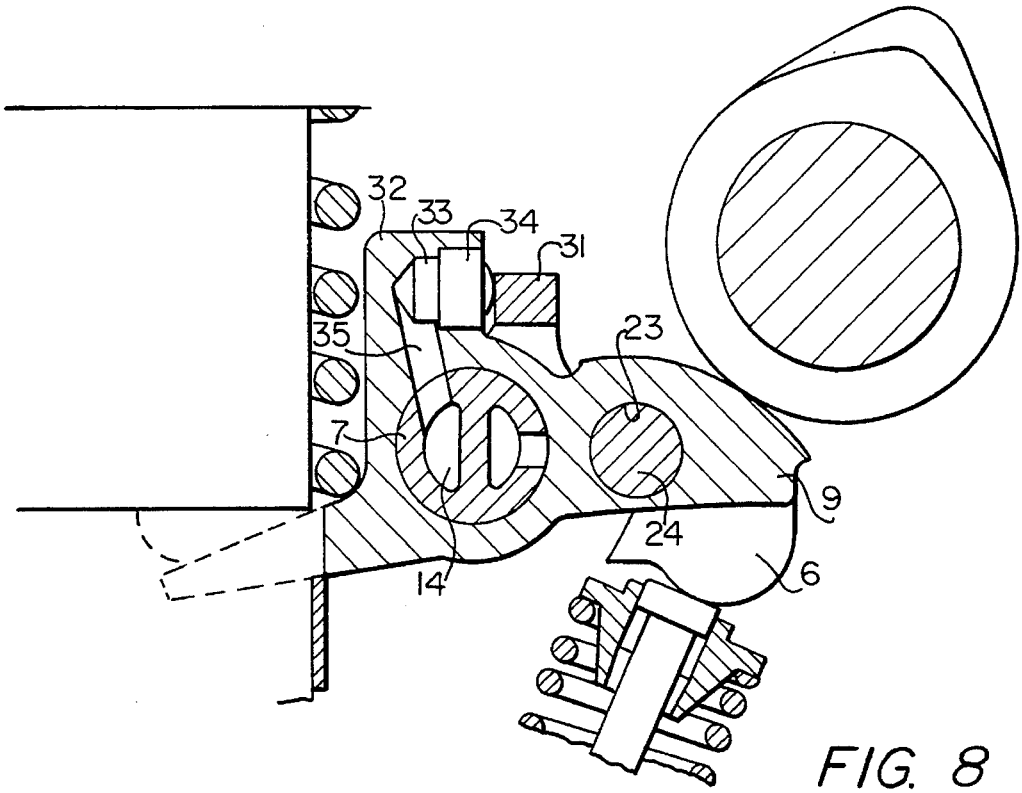
FIG. 8 shows a section along the line 8—8 in FIG. 5

If the selector roller 24 is rotated into the position shown in FIG. 7, a positive coupling occurs between the first rocker arms 6 and the second rocker arms 9 because the selector roller 24 cannot slide out of the holes 22 but is supported on the walls of the holes 22 over the peripheral region 27.

In order to pivot the selector roller 24, an eccentric prolongation 28 is provided on each end and this engages in a longitudinal slot 29 of a ring 30 which is rotatably supported on the pivot shaft 7 of the rocker arms. The two rings 30 are connected together by means of a bridge-piece 31. As may be seen from FIG. 8 in particular, the second rocker arms 9 are each provided with a prolongation 32 with a hole 33 in which is arranged a piston 34 which is in contact with the bridge-piece 31. The piston 34 is pushed outwards by a pressure medium, which is supplied to the hole 33 through the passage 14 in the shaft 7 and a passage 35 in the rocker arm 9, so that the rings 30 are rotated and, by means of their longitudinal slots 29, take the eccentric prolongations 28 with them so that the selector roller 24 is rotated into the position represented in FIG. 7. The selector roller 24 is returned into the decoupled position in accordance with FIG. 6 with the aid of a torsion spring 36 whose central region is fixed in the second rocker arms 9 and whose ends engage in prolongations 37 of the rings 30.

The first rocker arms 6 are held in contact on their cams 2, 3 and 4 in the usual manner by the valve springs 1. In order to hold the second rocker arms 9 in contact with their cams 8, the second rocker arms 9 are provided, in this embodiment example, with prolongations 38, which are directed backwards and partially surround a spark plug dome 39. A spring 40 is arranged on the spark plug dome and is supported, at one end, on a stationary spring plate 41 and, at the other end, on a displaceable spring plate 42 which interacts with the prolongations 38 of the second rocker arms 9.

Figure 9:
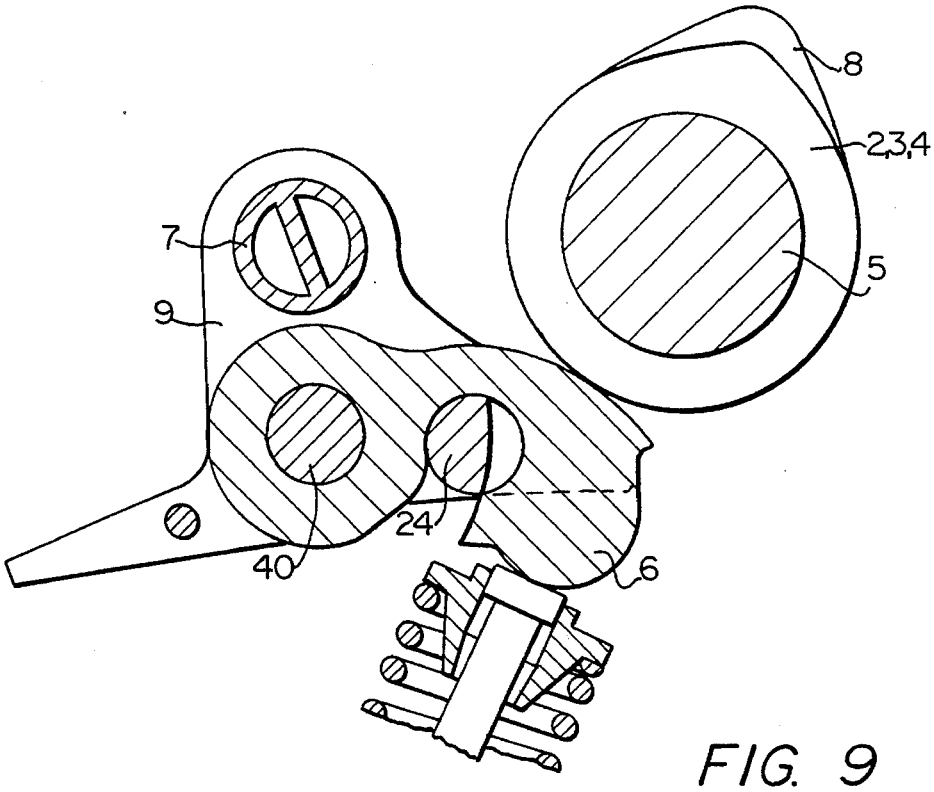
FIG. 9 shows a modification of the embodiment example of FIGS. 4 to 8 in a section corresponding to FIG. 6.

The embodiment in accordance with FIG. 9 differs from that in accordance with FIGS. 4 to 8 essentially only in that the second rocker arms 9 are supported on the stationary shaft 7 whereas the first rocker arms 6 are supported on a shaft 40 which extends parallel to the shaft 7 and is supported in the second rocker arms 9. The coupling and decoupling of the first rocker arms 6 to and from the second rocker arms 9 takes place, as in the embodiment example in accordance with FIGS. 4 to 8, by means of a selector roller 24 which, in the position represented which corresponds to the position in accordance with FIG. 6, permits pivoting of the second rocker arms 9 without the first rocker arms 6 being taken along with them and, in the case of a rotation into the position represented in FIG. 7, connects the first and second rocker arms together for common pivoting in accordance with the contour of the cams 8.

We claim:

1. A valve actuation mechanism for an internal combustion engine including at least two inlet valves (E) per cylinder, comprising:

means for actuating said inlet valves, said actuating means including a camshaft having cams, and first and second rocker arms (6 and 9);

a common shaft for pivotally supporting said first rocker arms (6), and first cams (2,3,4), said first rocker arms interacting with said inlet valves and said first cams for a first rotational speed range;

a common shaft for pivotally supporting said second rocker arms (9), and second cams (8), said second rocker arms interacting with said inlet valves and said second cams for a second rotational speed range;

coupling means (13, 24) for selectively coupling said first and second rocker arms together in said second rotational speed range and for decoupling said first and second rocker arms in said first rotational speed range; and including three of said inlet valves and three of said first rocker arms per cylinder;

two of said second rocker arms, each one arranged between two adjacent first rocker arms; and two of said second cams being substantially identically contoured for interacting with said two second rocker arms.

2. Valve actuation mechanism according to claim 1, wherein longitudinal center axes (6*a* and 21 respectively) of each said first rocker arm (6) and of a valve (E) actuated by each said first rocker arm are located in a common plane.

3. Valve actuation mechanism according to claim 1 or 2, wherein said two second rocker arms (9) are rigidly connected together or are integral.

4. Valve actuation mechanism according to claim 3, wherein said second rocker arms (9) are pivotably supported on said common shaft of said first rocker arms (6).

5. Valve actuation mechanism according to claim 4, characterized in that the valve center axes (21) of said inlet valves (E) intersect a central axis of said camshaft.

6. Valve actuation mechanism according to claim 3, wherein said two second rocker arms (9) include free ends and further including a tie-bar (10) for connecting together said free ends;

said first rocker arms include free ends and said tie-bar being located in front of and at a small distance from said first rocker arm free ends;

said first rocker arms include holes (11) and said tie-bar includes holes (12), and said first rocker armholes being aligned with said tie-bar holes when said valves are closed; and including pistons (13) accommodated in said first rocker armholes (11) and displaceable into said tie-bar holes (12) by oil pressure;

springs (15) arranged in said first rocker arm holes (11) and acting against a displacement of said pistons into said tie-bar holes, and sleeves (17) connected to said pistons for supporting said springs on one end;

inserts (16) fixed in said first rocker arm holes (11) for supporting said springs at a second end and for receiving said sleeves (17); and an oil supply passage (14) in said first rocker arm common shaft and in communication with said first rocker arm holes (11).

7. Valve actuation mechanism according to claim 1, wherein said first and second rocker arms (6,9) include holes (22,23) extending parallel to said common shaft for said first rocker arms and which are coaxial when said valves are closed; and including a rotatable selector roller (24) which extends through said first rocker arm holes (22) and includes cut-outs (22) in the region of said first rocker arm holes, and said roller extends through said second rocker armholes (23) and is supported therein;

said first rocker arm holes (22) including an open region (26) through which said selector roller can pass to decouple said first and second rocker arms when said selector roller is rotated to a first position, said selector roller rotatable to a second position in which it couples together said first and second rocker arms.

8. Valve actuation mechanism according to claim 7, wherein said selector roller (24) includes ends having prolongations (28) eccentric to a longitudinal centerline of said selector roller; and including rings (30) rotatably supported on ends of said common shaft for said first rocker arms and each including a longitudinal slot (29) for engaging said prolongations of said selector roller;

a spring (36) for holding said rings (30) in a first position corresponding to said first position of said selector roller;

at least one hydraulic piston (34) for pivoting said rings against the force of said spring into a second position in which the selector roller is located in its respective second position.

9. Valve actuation means according to claim 8 further including a bridge-piece (31) for connecting together two said rings (30);

said at least one hydraulic piston (34) acting on said bridge-piece;

a longitudinal passage (14) in said common shaft for said first rocker arms for supplying a pressure medium to said hydraulic piston.

10. Valve actuation mechanism according to claim 8 wherein said second rocker arms are pivotally supported on a stationary common shaft (7), and said first rocker arms are pivotally supported on a second common shaft (40) that is parallel to said stationary common shaft and is supported in said second rocker arms.

* * * * *